US012256777B2

(12) United States Patent
Chan et al.

(10) Patent No.: US 12,256,777 B2
(45) Date of Patent: Mar. 25, 2025

(54) NON-COMBUSTIBLE AEROSOL PROVISION DEVICE

(71) Applicant: NICOVENTURES TRADING LIMITED, London (GB)

(72) Inventors: Justin Han Yang Chan, London (GB); Liu Chuan, London (GB); Caner Yurteri, London (GB); Colin Dickens, London (GB); Walid Abi Aoun, London (GB); John McAughey, London (GB)

(73) Assignee: NICOVENTURES TRADING LIMITED, London (GB)

( * ) Notice: Subject to any disclaimer, the term of this patent is extended or adjusted under 35 U.S.C. 154(b) by 302 days.

(21) Appl. No.: 17/756,528

(22) PCT Filed: Nov. 27, 2020

(86) PCT No.: PCT/EP2020/083798
§ 371 (c)(1),
(2) Date: May 26, 2022

(87) PCT Pub. No.: WO2021/105476
PCT Pub. Date: Jun. 3, 2021

(65) Prior Publication Data

US 2022/0408807 A1 Dec. 29, 2022

(30) Foreign Application Priority Data

Nov. 29, 2019 (GB) ..... 1917459

(51) Int. Cl.
*A24F 40/40* (2020.01)
*A24F 40/30* (2020.01)
*A24F 40/70* (2020.01)

(52) U.S. Cl.
CPC ..... *A24F 40/40* (2020.01); *A24F 40/30* (2020.01); *A24F 40/70* (2020.01)

(58) Field of Classification Search
CPC ..... A24F 40/40; A24F 40/70; A24F 40/30
(Continued)

(56) References Cited

U.S. PATENT DOCUMENTS 8,833,364 B2 9/2014 Buchberger
2005/0268911 A1* 12/2005 Cross ..... A61M 11/042 128/203.26
(Continued)

FOREIGN PATENT DOCUMENTS

EA 12481 B1 10/2009
GB 2534212 A 7/2018
(Continued)

OTHER PUBLICATIONS

International Search Report and Written Opinion for Application No. PCT/EP2020/083798, mailed on Apr. 28, 2021, 21 pages.

*Primary Examiner* — Gary F Paumen
(74) *Attorney, Agent, or Firm* — WOMBLE BOND DICKINSON (US) LLP

(57) ABSTRACT

An article for use within a non-combustible aerosol provision system includes an aerosol-generating material having a top side, a barrier positioned adjacent to the top side of the aerosol-generating material and at least one passageway defined by the barrier and extending away from the top side of the aerosol-generating material. The at least one passageway is configured to, in use, allow aerosol to escape from the aerosol-generating material and provide a condensation region for the escaping aerosol.

19 Claims, 9 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2011/0233043 | A1* | 9/2011 | Cross | A61M 16/14 202/185.1 |
| 2013/0180525 | A1* | 7/2013 | Cross | A61M 11/042 128/203.27 |
| 2016/0345630 | A1 | 12/2016 | Mironov et al. | |
| 2017/0105246 | A1* | 4/2017 | Cross | A61M 16/14 |
| 2018/0007965 | A1 | 1/2018 | Karles | |
| 2018/0015385 | A1 | 1/2018 | Meinhart et al. | |
| 2019/0001087 | A1 | 1/2019 | Davidson et al. | |
| 2019/0350262 | A1* | 11/2019 | Saygili | A24F 7/00 |
| 2021/0037886 | A1* | 2/2021 | Mironov | H05B 3/34 |

FOREIGN PATENT DOCUMENTS

| | | | | |
|---|---|---|---|---|
| GB | 2534213 | A | 7/2018 | |
| GB | 2534214 | A | 7/2018 | |
| GB | 2534215 | A | 7/2018 | |
| JP | 2012506263 | A | 3/2012 | |
| JP | 2017506509 | A | 3/2017 | |
| JP | 2019504671 | A | 2/2019 | |
| JP | 2019524066 | A | 9/2019 | |
| JP | 2021521834 | A | 8/2021 | |
| RU | 2683656 | C2 | 4/2019 | |
| WO | 2016120344 | A2 | 8/2016 | |
| WO | 2018134159 | A1 | 7/2018 | |
| WO | 2019206334 | A1 | 10/2019 | |
| WO | WO-2019224068 | A1 * | 11/2019 | A24B 15/14 |

* cited by examiner

NON-COMBUSTIBLE AEROSOL PROVISION DEVICE

PRIORITY CLAIM

The present application is a National Phase entry of PCT Application No. PCT/EP2020/083798, filed Nov. 27, 2020, which claims priority from GB Patent Application No. 1917459.8, filed Nov. 29, 2019, both of which are hereby fully incorporated herein by reference.

TECHNICAL FIELD

This invention relates to a non-combustible aerosol provision device and also to an article, which may be for use within a non-combustible aerosol provision device.

BACKGROUND

Smoking articles such as cigarettes, cigars and the like burn tobacco during use to create tobacco smoke. Attempts have been made to provide alternatives to these articles that burn tobacco by creating products that release compounds without burning.

Examples of such articles are heating devices which release compounds by heating, but not burning, the material. The material may be, for example, tobacco or other non-tobacco products, which may or may not contain nicotine.

Heating tobacco or non-tobacco products may volatilize at least one component of the tobacco or non-tobacco products, typically to form an aerosol which can be inhaled, without burning or combusting the tobacco or non-tobacco products. Such apparatus is sometimes described as a 'heat-not-burn' apparatus or a 'tobacco heating product' (THP) or 'tobacco heating device' or similar. Various different arrangements have been tried for volatilizing at least one component of tobacco or non-tobacco products.

SUMMARY

A first aspect of the invention provides an article. The article comprises: an aerosol-generating material having a top side; a barrier positioned adjacent to the top side of the aerosol-generating material; at least one passageway defined by the barrier and extending away from the top side of the aerosol-generating material; and wherein the at least one passageway is configured to, in use, allow aerosol to escape from the aerosol-generating material and provide a condensation region for the escaping aerosol.

In some examples, the aerosol-generating material may comprise an amorphous solid. In some examples, the aerosol-generating material comprises an aerosol-generating gel.

In some examples, the barrier may have a top side. In some examples, the barrier may have a bottom side.

In some examples, the barrier may comprise a sheet of material and the at least one passageway may extend from the bottom side of the barrier to at least the top side of the barrier.

In some examples, the barrier may be paper or card.

In some examples, that at least one passageway may extend from the bottom side of the barrier to at least a top side of the barrier.

In some examples, the bottom side of the barrier may be bonded to the top side of the aerosol-generating material.

In some examples, the at least one passageway may be defined by a wall of the barrier and a portion of the wall may extend a distance beyond the top side of the barrier. In some examples, the portion of the wall may extend a distance of 0.1 mm to 10 mm. In some examples, the portion of wall extending beyond the top side of the barrier may extend around the entire perimeter of the at least one passageway.

In some examples, a plurality of vents may be provided in the aerosol-generating material and the plurality of vents may be located in an area of the aerosol-generating material exposed by the at least one passageway. In some examples, the vents may comprise apertures. In some examples, the vents may comprise burst points. In some examples, the plurality of vents may comprise at least five vents. In some examples, the plurality of vents may be arranged in a quincunx arrangement.

In some examples, the barrier may comprise at least one inlet to permit air to flow, in use, into the at least one passageway. In some examples, the inlet may pass through the wall of the barrier.

In some examples, the at least one passageway may be one of a plurality of identical passageways defined by the barrier.

In some examples, the aerosol-generating material comprises a plurality of spots, wherein each spot is located under a respective one of the passageways.

In some examples, the article is flat.

In some examples, the article may comprise a substrate and a bottom side of the aerosol-generating material may be positioned adjacent to a top side of the substrate. In some examples, the bottom side of the aerosol-generating material is bonded to the top side of the substrate.

In some examples, the article may have a bottom side that is configured to be placed adjacent to a heater provided in a non-combustible aerosol provision device.

In some examples, the article may comprise a susceptor. In some examples, the susceptor may comprise one or more materials selected from the group consisting of: an electrically-conductive material, a magnetic material, and a magnetic electrically-conductive material. In some examples, the susceptor may comprise a metal or a metal alloy. In some examples, the susceptor may comprise one or more materials selected from the group consisting of: aluminium, gold, iron, nickel, cobalt, conductive carbon, graphite, plain-carbon steel, stainless steel, ferritic stainless steel, steel, molybdenum, silicon carbide, copper, and bronze.

In some examples, the substrate may comprise the susceptor.

A second aspect of the invention provides an aerosol provision device comprising an induction heating system and a receiving portion. The receiving portion is configured to receive any of the example articles described herein comprising a susceptor.

A third aspect of the invention provides a non-combustible aerosol provision device. The non-combustible aerosol provision device comprises a receiving portion, the receiving portion including a heater and a closable lid, and the receiving portion is configured to receive, adjacent to the heater, any of the example articles described herein.

In some examples, the heater may be a flat metallic bed and wherein the heater may be heated by one of: conduction, convection, induction, or radiation.

In some examples, the lid may be arranged so that it covers the article receivable in the device and allows a space for the aerosol generated from the article to escape.

In some examples, the lid may be configured to, in use, press the article receivable in the device against the heater.

In some examples, the lid may comprise protrusions and the protrusions may be arranged so that, when the lid is in the closed position, the protrusions are configured to contact the article receivable in the device. In some examples, the lid or the protrusions may be biased such that, when the lid is in the closed position, the protrusions provide a constant load force on the article receivable in the device. In some examples, the protrusions may be longer than the portion of the wall that extends a distance beyond the top side of the barrier.

In some examples, the non-combustible aerosol provision device further comprises a mouthpiece and an air inlet.

A fourth aspect of the invention provides a non-combustible aerosol provision system comprising: a non-combustible aerosol provision device of the second aspect of the invention in combination with any of the example articles of the first aspect of the invention as described herein and comprising a susceptor. The article according to the first aspect of the invention may have any of the of the above-described example features of the first aspect of the present invention.

A fifth aspect of the invention provides a non-combustible aerosol provision system comprising: a non-combustible aerosol provision device of the third aspect of the invention in combination with any of the example articles of the first aspect of the invention as described herein. The non-combustible aerosol provision device according to the third aspect of the invention may have any of the of the above-described example features of the third aspect of the present invention. The article according to the first aspect of the invention may have any of the of the above-described example features of the first aspect of the present invention.

A sixth aspect of the invention provides a non-combustible aerosol provision device. The non-combustible aerosol provision device comprises: a receiving portion, the receiving portion including a heater, wherein the receiving portion is configured to receive an article adjacent to the heater, the article comprising an aerosol-generating material having a top side; a barrier having a bottom side, the bottom side of the barrier configured to be positioned adjacent to the top side of the aerosol-generating material when it is received in the receiving portion; and at least one passageway defined by the barrier, the at least one passageway extending from the bottom side of the barrier and extending away from the top side of the aerosol-generating material when it is received in the receiving portion, wherein the at least one passageway is configured to, in use, allow aerosol to escape from the aerosol-generating material and provide a condensation region for the escaping aerosol.

In some examples, the at least one passageway may be defined by a wall of the barrier and a portion of the wall may extend a distance beyond a top side of the barrier.

In some examples, the portion of wall extending beyond the top side of the barrier may extend around the entire perimeter of the at least one passageway.

In some examples, the non-combustible aerosol provision device may comprise a closable lid, which is arranged so that it covers the article when it is received in the device and allows a space for the aerosol generated from the article to escape, wherein the closable lid comprises the barrier.

In some examples, the barrier may be arranged so that, when the lid is in the closed position, the barrier is configured to contact the article when received in the device.

In some examples, the closable lid may be biased such that, when the lid is in the closed position, the barrier provides a constant load force on the article when received in the device.

In some examples, the at least one passageway may be one of a plurality of identical passageways defined by the barrier.

In some examples, the non-combustible aerosol provision device may comprise a mouthpiece and an air inlet.

A seventh aspect of the invention provides a non-combustible aerosol provision system comprising: a non-combustible aerosol provision device of the sixth aspect of the invention in combination with at least one article comprising an aerosol-generating material.

Further features and advantages of the invention will become apparent from the following description of preferred embodiments of the invention, given by way of example only, which is made with reference to the accompanying drawings.

DETAILED DESCRIPTION

Figure 1:
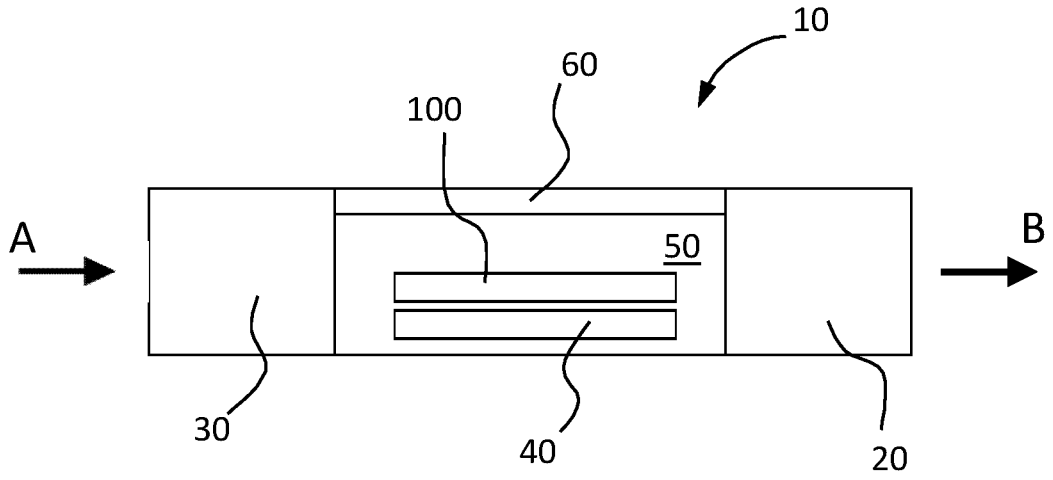
FIG. 1 shows a schematic of an embodiment of a non-combustible aerosol provision device.

FIG. 1 shows, schematically, an embodiment of a non-combustible aerosol provision device 10 for generating an aerosol from an article 100. The article 100 may be receivable in the device 10.

The non-combustible aerosol provision device 10 may include a mouthpiece 20 through which a user of the device 10 may inhale an aerosol generated by the device 10. The non-combustible aerosol provision device 10 may include an air inlet 30 through which air is drawn when the user inhales an aerosol generated by the device 10. As FIG. 1 shows, air may be drawn in in the direction of arrow A and an aerosol may be drawn in the direction of arrow B.

In certain examples, the non-combustible aerosol provision device 10 may include a heater 40. The heater 40 may be, for example, a heater element. The heater 40 may be configured to heat the article 100. Activating the heater 40 may be triggered by the user inhaling air through the device 10 or by another means, for example by a switch. The non-combustible aerosol provision device 10 may comprise a plurality of heater elements.

In certain embodiments, the heater may comprise one or more electrically resistive heaters, including for example one or more nichrome resistive heater(s) and/or one or more ceramic heater(s). The one or more heaters may comprise one or more induction heaters which includes an arrangement comprising one or more susceptors which may form a chamber into which an article comprising aerosolizable material is inserted or otherwise located in use. Alternatively or in addition, one or more susceptors may be provided in the aerosolizable material. Other heating arrangements may also be used.

In certain examples, the non-combustible aerosol provision device 10 may include an induction heating system as described herein. The induction heating system may be used to heat the heater 40 in some examples. In other examples, the induction heating system may be used to heat at least a portion of the article 100, such as a susceptor as described below. In some examples, the non-combustible aerosol provision device 10 may not include a heater.

The non-combustible aerosol provision device 10 may include a receiving portion 50. The receiving portion 50 may be configured to receive an article 100. The receiving portion 50 may, in use, receive an article 100. The receiving portion 50 may be configured to allow air to pass from the air inlet 30 through the receiving portion 50 and out to the mouthpiece 20 when the user inhales on the mouthpiece 20. The air passed through the receiving portion 50, when the user inhales, may collect any generated aerosol from the article 100 before entering the user's mouth.

The heater 40 may be included in the receiving portion 50 of the device 10. The heater 40 may be located in the receiving portion 50 or immediately adjacent to the receiving portion 50. The heater 40 may form a wall of the receiving portion 50.

The receiving portion 50 may include a lid 60. The lid 60 may be a closable lid. The lid 60, when closed, may cover the article 100. The lid 60, when closed, may enclose the receiving portion 50 so as to form an enclosed space through which air is drawn from the air inlet 30 to the mouthpiece 20 by a user. The lid 60, when closed, may be spaced from the article 100 received in the receiving portion 50. Spacing the lid 60, when closed, from the article 100 allows the aerosol generated from the article 100 to escape.

The device 10 may include other componentry that is not shown in FIG. 1. For example, the device 10 may have a power source compartment, which holds a source of power which may be, for example, a battery, for providing electrical energy to the device 10. The device 10 may have electrical circuitry connected to the power source for conducting electrical energy to other components within the device 10. For example, the circuitry may connect the power source to the heater 40. The circuitry may be, for example, wires or the like.

It may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A colloid is a substance in which microscopically dispersed insoluble particles are suspended throughout another substance.

For reasons of convenience, as used herein the term aerosol should be taken as meaning an aerosol, a vapor or a combination of an aerosol and vapor.

Figure 2:
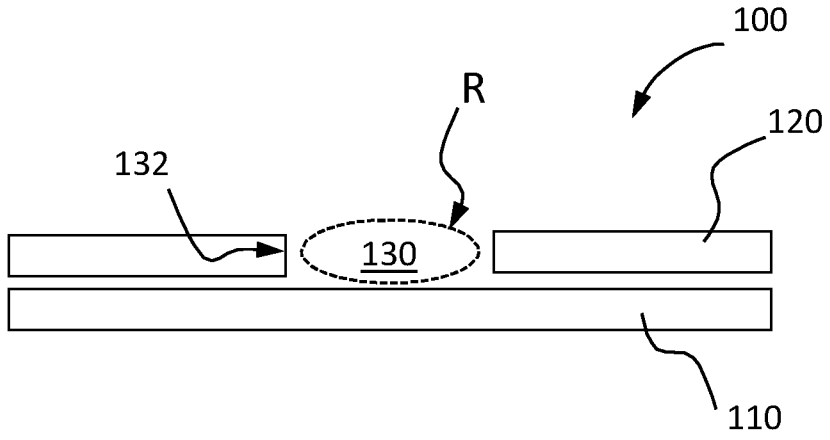
FIG. 2 shows a schematic view of an embodiment of an article.

Referring now to FIG. 2, there is shown a schematic view of an embodiment of an article 100. The article 100 may be receivable in the receiving portion 50 of the non-combustible aerosol provision device 10. The article 100 comprises an aerosol-generating material 110. The aerosol-generating material 110 may be an aerosol-generating material layer. For example, the aerosol-generating material 110 may comprise a thin film of aerosol-generating material. The article 100 also comprises a barrier, which in this implementation is formed by a barrier layer 120. Other implementations of barrier are conceivable. As will be described below in more detail, the barrier is an element which provides a partially enclosed volume above the aerosol-generating material 110 into which vapor/aerosol is provided during heating (or more generally atomizing) the aerosol-generating material 110. The partially enclosed volume enables vapor to be collected and to condense to form aerosol.

In the example of FIG. 2, the bottom side of the barrier layer 120 is positioned adjacent to the top side of the aerosol-generating material 110. In some examples, the barrier layer 120 directly contacts the top surface of the aerosol-generating material 110.

At least one passageway 130 is defined by the barrier. For example, the at least one passage way may be defined by the barrier layer 120. The passageway 130 here is the partially enclosed volume defined by the barrier layer 120. The barrier layer 120 in this example is one or more sheets of material, e.g., card, having a cut-out portion which extends through the barrier layer 120 and forms the passageway 130. That is, the passageway 130 extends from the bottom side of the barrier layer 120 and extends away from the top side of the aerosol-generating material 110. The at least one passageway 130 exposes a portion of aerosol-generating material 110, which in this implementation would otherwise be located beneath the barrier layer 120. The at least one passageway 130 may extend from the bottom side of the barrier layer 120 to at least a top side of the barrier layer 120. The at least one passageway 130 is defined by a wall 132 of the cut-out portion of the barrier layer 120. The wall 132 of the barrier layer 120 may extend from the bottom side of the barrier layer 120 to at least the top side of the barrier layer 120.

It should be appreciated that while the barrier layer 120 of the present disclosure includes a sheet or material having a cut-out, with the cut-out defining a wall 132 of the passageway 130, the passageway 130 may be realized in other ways. For example, the barrier may instead comprise a lattice/trellis type structure (or a mesh). Equally, the barrier may be a stand-alone wall formed into an enclosed shape (e.g., a ring or a square) to form the partially enclosed volume. In essence, the barrier provides one or more walls which, when placed adjacent the aerosol-generating material 110, create an enclosed volume above the aerosol-generating material 110 bounded by the one or more walls extending away from the aerosol-generating material 110. The aerosol-generating material 110 may include one or multiple partially enclosed volumes above the aerosol-generating material 110.

When an aerosol is generated from the article 100 the passageway 130 allows the aerosol to escape from the aerosol-generating material 110. The Applicant has found that the provision of at least one passageway 130 above the aerosol-generating material 110 improves the generation of an aerosol from the aerosol-generating material 110. Without wishing to be bound by theory, the Applicant believes that the provision of at least one passageway 130 above the aerosol-generating material 110 provides a condensation region for the escaping aerosol. See condensation region R in FIG. 2. In particular, it is thought that the at least one passageway 130 provides a region for vapor/aerosol to collect without too much dispersion (i.e., the majority of the vapor is located in the passageway 130). When a user inhales on the device and air is passed over the top of the article 100 (i.e., over the open end of the passageway 130), the cool air causes the vapor contained in the condensation region R to condense further and ultimately form a more consistent aerosol (e.g., having a more consistent particle distribution size, etc.).

The article 100 may be configured to be heated, in use, so as to form the aerosol inhaled by the user of the device 10.

In certain examples, the article 100 may be configured to be heated by the heater 40 described above with respect to FIG. 1.

In certain examples, the article 100 may be configured to be heated by a heating system provided in the device 10, such as an induction heating system. In certain examples, the article 100 may comprise a susceptor. The induction heating system may, in use, cause heating of the susceptor so as to form the aerosol inhaled by the user of the device 10.

As used herein, a "susceptor" is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein. The induction heating system of the non-combustible aerosol provision device 10 may, therefore, comprise a magnetic field generator.

Where the article 100 comprises a susceptor, the susceptor may comprises one or more materials selected from the group consisting of: an electrically-conductive material, a magnetic material, and a magnetic electrically-conductive material. In certain examples, the susceptor may comprise a metal or a metal alloy. In some cases, the susceptor may comprise one or more materials selected from the group consisting of: aluminum, gold, iron, nickel, cobalt, conductive carbon, graphite, plain-carbon steel, stainless steel, ferritic stainless steel, steel, molybdenum, silicon carbide, copper, and bronze.

Where the article 100 is to be heated by the heater 40, the bottom side of the aerosol-generating material 110 may be configured to be placed adjacent to the heater 40 when the article 100 is received in the receiving portion 50 of the non-combustible aerosol provision device 10. In other words, the aerosol-generating material 110 of the article 100 may be placed against the heater 40 in the receiving portion 50 by a user of the device. The heating element 40 may, for example, be in the form of a ceramic or metal lining on an inner surface of the receiving portion 50 of the device 10.

The heater 40 may be configured to heat but not burn the aerosol-generating material of the aerosol-generating material 110. The heater 40 may heat the aerosol-generating material by conduction, or any other heat transfer mechanism, e.g., convection or radiative. The heater 40 may be a metallic bed. The heater 40 itself may provide the source of heat. For example, the heater 40 may be a thin film, electrically resistive heater. Alternatively, the heating element 40 may be, for example, a wire, which may, for example, be in the form of a coil, a mesh, or a film heater. Further, in some examples, the article 100 may include a susceptor (e.g., as a layer onto which the aerosol-generating material is attached) and the heater 40 may be a work coil that is driven with an alternating current to produce a varying magnetic field.

Alternatively, a heater means may be provided to heat the heater 40 in use. For example, the heater means may comprise induction heating or radiation heating. For example, the device 10 may comprise an induction heating system configured to cause heating of the heater 40. In other examples, radiant heat may comprise sources such as LEDs or LASERs. Alternatively still, the heater means may comprise a chemical heat source which undergoes an exothermic reaction to product heat in use.

In one example, the heating element 40 for heating the aerosol-generating material may operate optimally at temperatures between around 50° C. to around 250° C. or 300° C. In some cases, the temperature of the aerosol-generating material during heating may be raised up to 400° C.

In certain examples, the aerosol-generating material 110 may comprise an amorphous solid. In certain examples, the aerosol-generating material 110 may comprise a thin film. For example, the aerosol-generating material 110 may comprise a gel. The gel may be formed in a thin film. Alternatively, the aerosol-generating material 110 may comprise a foam. The foam may be formed in a thin film. The aerosol-generating material 110 may contain or be tobacco, for example reconstituted tobacco. However, it should be appreciated that any suitable aerosol-generating material may be used to form the aerosol-generating material 110.

The aerosol-generating material 110 may contain a nicotine source and no tobacco material. Alternatively, the aerosol-generating material 110 may contain a tobacco material and no separate nicotine source.

In embodiments where the aerosol-generating material 110 comprises a gel, the gel may comprise the nicotine source. In some cases, the gel may comprise the tobacco material. In some cases, the gel may comprise a tobacco material and a separate nicotine source.

In embodiments where the aerosol-generating material 110 comprises a gel, the gel may comprise a gelling agent. The gelling agent may comprise a hydrocolloid. Suitably, the gel may comprise an aerosol generating agent.

In embodiments where the aerosol-generating material 110 comprises a gel, the gel may comprise a flavor. In some cases, the flavor (if present) comprises, consists essentially of, or consists of menthol. In some cases, the gel does not comprise a flavor.

In embodiments where the aerosol-generating material 110 comprises a gel, the gel may additionally comprise a tobacco material and/or nicotine. For example, the gel may additionally comprise powdered tobacco and/or nicotine and/or a tobacco extract.

In embodiments where the aerosol-generating material 110 comprises a gel, the gel may comprise a hydrogel. The gel may additionally comprise a solvent.

The barrier layer 120 of the article 100 may be formed from a sheet of material. The passageway 130 defined by the barrier layer 120 may extend from the bottom side of the barrier layer to at least the top side of the barrier layer 120. The wall 132 of the barrier layer 120, which defines the passageway 130, may extend from the bottom side of the barrier layer 120 to at least the top side of the barrier layer 120. In another embodiment, a portion of the wall 132 of the barrier layer 132 may extend a distance beyond the top side of the barrier layer 120.

The at least one passageway 130 may extend from the bottom side of the barrier layer 120 to at least a top side of the barrier layer 120. The at least one passageway 130 may be defined by a wall 132 of the barrier layer 120.

In an embodiment, the barrier layer 120 may be substantially impermeable. This prevents aerosol or gas passage through the barrier layer 120, which may help to ensure that the generated aerosol passes through the at least one passageway 130 and can condense in the condensation region R.

The barrier layer 120 may be formed from any suitable material that can be used to provide a suitable passageway 130. The barrier layer 120 may be formed from materials selected from metal foil, paper, card, cardboard, carbon paper, ceramic, plastic or combinations thereof. For example, the barrier layer 120 may be formed from a laminate comprising multiple layers of one of materials selected from the preceding list. In another example, the barrier layer 120 may be formed from a laminate comprising layers of differing materials selected from the preceding list. In another example, the barrier layer 120 may be a paper-backed foil. The foil may be substantially impermeable to gas/aerosol and therefore provide the impermeable characteristics that, as described above, may be desirable.

The barrier layer 120 may abut the aerosol-generating material 110. The bottom side of the barrier layer 120 may abut the top side of the aerosol-generating material 110. The barrier layer 120 may be bonded to the aerosol-generating material 110; e.g., using a suitable adhesive, such as PVA, for example.

Where the aerosol-generating material 110 comprises a gel, as described hereinbefore, the bottom surface of the barrier layer 120 may be bonded to the top surface of the aerosol-generating material 110 using the bonding tendency of the gel itself. The Applicant has found that an aerosol-generating material 110 comprising a gel binds well to paper-based barrier layers—for example, paper, card or cardboard. Without wishing to be limited by theory, it is thought that a gel formed using a slurry partially impregnates the paper so that when the gel sets and forms cross-links, the paper is partially bound into the gel. A suitably strong binding between the gel and a paper-based barrier layer 120 is then formed.

Figure 3:
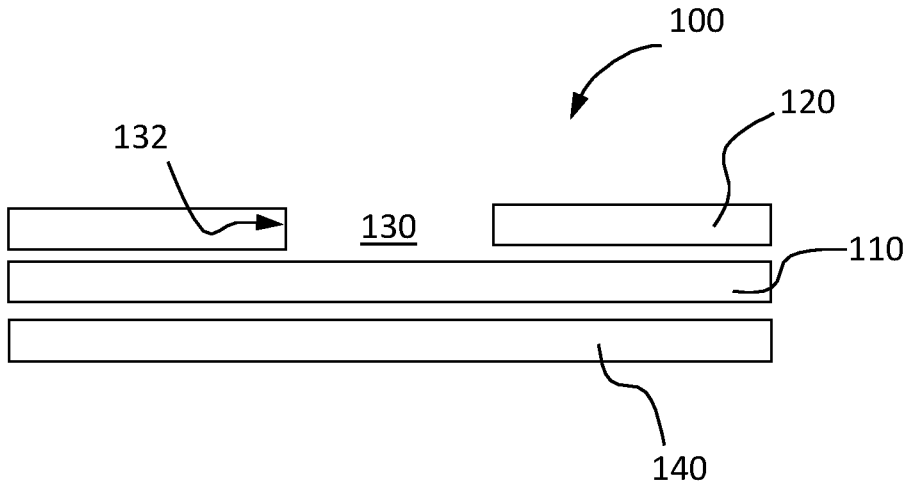
FIG. 3 shows a schematic view of another embodiment of an article.

Referring now to FIG. 3, there is shown a schematic view of an embodiment of an article 100. As with the article 100 of FIG. 2, the article 100 may be receivable in the receiving portion 50 of the non-combustible aerosol provision device 10. Common reference numerals are used throughout the figures to indicate similar features. Thus, as with the article 100 of FIG. 2, the article 100 of FIG. 3 has an aerosol-generating material 110 and a barrier layer 120. The barrier layer 120 defines at least one passageway 130 extending from the bottom side of the barrier layer 120 and extending away from the top side of the aerosol-generating material 110.

The article 100 may comprise a substrate 140. A bottom side of the aerosol-generating material 110 may be positioned adjacent to a top side of the substrate 140. The substrate 140 may act to support and stabilize the aerosol-generating material 110, which may otherwise be fragile and vulnerable to damage in use, particularly when being inserted into the receiving portion by a user of the device 10. The substrate 140 may act to improve handling and packaging of the article 100.

In certain examples, the bottom side of the substrate 140 may be configured to be placed adjacent to the heater 40 when the article 100 is received in the receiving portion 50 of the non-combustible aerosol provision device 10. In other words, the substrate 140 of the article 100 may be placed against the heater 40 in the receiving portion 50 by a user of the device. In this way, the substrate 140 may act to protect the aerosol-generating material 110 from direct contact with the heater 40, which may otherwise cause the aerosol-generating material to degrade incorrectly in use and not form an aerosol in the desired manner. The substrate 140 may also act to protect the heater 40 from the aerosol-generating material 110. For example, direct contact with the heater 40 by the aerosol-generating material 110 may leave a residue or build-up of spent aerosol-generating material on the heater 40 after repeated use of a number of articles 100 in the device. Further, direct contact with the heater 40 by the aerosol-generating material 110 may corrode or damage the heater 40.

In an embodiment, the substrate 140 of the article 100 may be substantially impermeable. This may prevent aerosol or gas passage through the substrate 140, which helps to control the aerosol formation and help ensure it is delivered to the user. Having a substantially impermeable substrate 140 may also prevent condensation or other deposition of the aerosol or gas on, for example, the surface of the heater 40 when the article 100 is in use in the device 10.

The substrate 140 may be any suitable material which can be used to support an aerosol-generating material. The substrate 140 may be formed from materials selected from metal foil, paper, card, cardboard, carbon paper, ceramic, plastic or combinations thereof. For example, the substrate 140 may be formed from a laminate comprising multiple layers of one of materials selected from the preceding list. In another example, the substrate 140 may be formed from a laminate comprising layers of differing materials selected from the preceding list. In another example, the substrate 140 may be a paper-backed foil. The foil may be substantially impermeable to gas and/or aerosol and therefore provide the impermeable characteristics that, as described above, may be desirable in the substrate 140. The foil may also help in conducting heat to the aerosol-generating material 110.

In certain examples, and where the article 100 comprises a susceptor as described above, the substrate 140 may comprise the susceptor. Thus, the substrate 140 may be heated by an induction heating system of the device 10, in use, and conduct heat to the aerosol-generating material 110.

The substrate 140 may abut the aerosol-generating material 110. The bottom side of the aerosol-generating material 110 may abut the top side of the substrate 140. The substrate 140 may be bonded to the aerosol-generating material 110.

Where the aerosol-generating material 110 comprises a gel, as described hereinbefore, the top side of the substrate 140 may be bonded to the bottom side of the aerosol-generating material 110 using the bonding tendency of the gel itself. As described above, the Applicant has found that an aerosol-generating material 110 comprising a gel binds well to paper-based barrier layers—for example, paper, card or cardboard.

Figure 4:
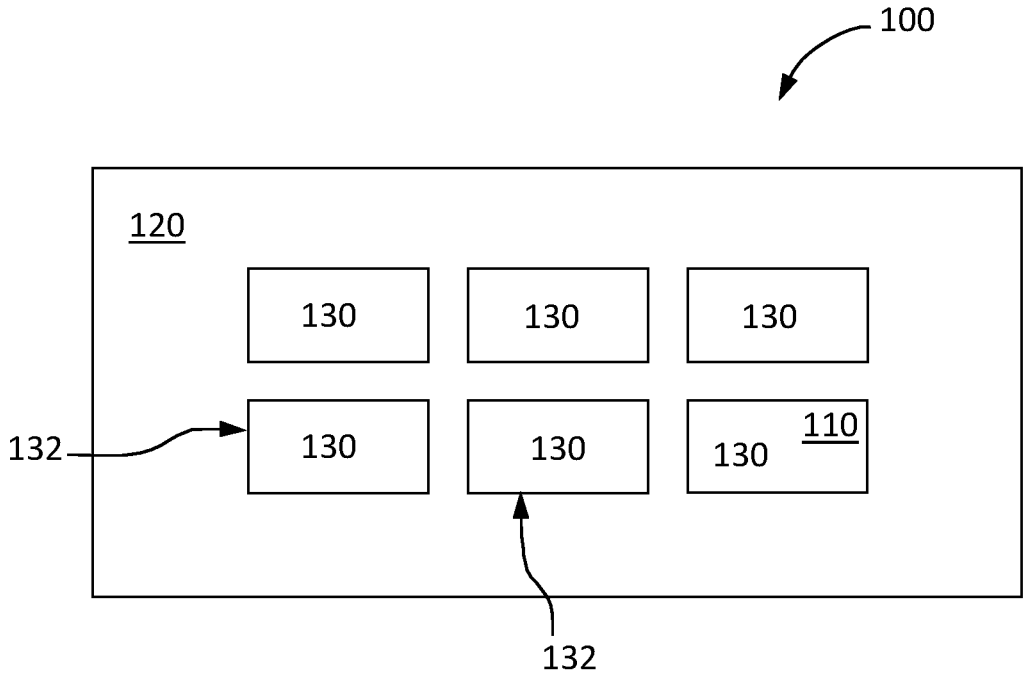
FIG. 4 is a top view of another embodiment of an article.

Referring now to FIG. 4, which shows a top view of an embodiment of an article 100. As FIG. 4 illustrates, the article 100 may be rectangular. Alternatively, the article 100 may be square or circular depending on the arrangement of the receiving portion 50. The surface area of the article 100 may be between 16 and 50 $mm^2$, for example. However, any desired surface area may be used to form the article 100. The thickness of the article 100 may be 0.015 mm to 1 mm, for example. The thickness of the aerosol-generating material 110 may be 0.015 mm to 1.0 mm, for example. Suitably, the thickness of the aerosol-generating material 110 may be in the range of about 0.05 mm, 0.1 mm or 0.15 mm to about 0.5 mm or 0.3 mm. An aerosol-generating material 110 having a thickness of 0.2 mm may be particularly suitable. The aerosol-generating material 110 may comprise more than one layer, and the thickness described herein refers to the aggregate thickness of those layers. The Applicant has established the preferred thickness of the aerosol-generating material 110 to ensure that the aerosol-generating material 110 is not too thick such that heating efficiency is compromised and not too thin such that the aerosol-generating material 110 is difficult to manufacture and handle; a very thin aerosol-generating material 110 may be harder to form, for example by casting and may be fragile, compromising aerosol formation in use. The thickness stipulated herein is a mean thickness for the material. In some cases, the amorphous solid thickness may vary by no more than 25%, 20%, 15%, 10%, 5% or 1%. It should be appreciated that the above thicknesses for the article 100 and aerosol-generating material 110 are exemplary only and in other implementations the thicknesses may be different from those specified.

As FIG. 4 also illustrates, the at least one passageway, described above, may be one of a plurality of passageways 130 defined by the barrier layer 120. For example, in some implementations there may be between 6 to 24 passageways. Each one of the plurality of passageways 130 may be identical. Each passageway 130 provides a corresponding condensation region for the escaping aerosol to condense before the aerosol is drawn from of the receiving portion 50 and out of the mouthpiece as the user inhales on the device 10. A plurality of passageways 130 allows multiple condensation regions R to be formed across the article 100 thereby improving the effectiveness of the article 100 and device 10 in generating an aerosol to be inhaled by a user.

As FIG. 4 also shows, the passageway(s) 130 may be any suitable shape. In the embodiment shown in FIG. 4, the passageways 130 are rectangular in shape. Alternatively, the passageways 130 may be circular or square for instance. The passageways 130 may be a series of apertures cut into the barrier layer 120 where the cutting of the barrier layer forms the wall 132 of each passageway 130.

Where a plurality of passageways 130 are provided, the aerosol-generating material 110 may be provided as a corresponding plurality of spots or regions located beneath the barrier layer 120. The area of the aerosol-generating material spots may be slightly larger than the area of the aerosol-generating material 110 exposed by each respective passageway 130. In other words, the area of the aerosol-generating material spots may be slightly larger than the projected area of each respective passageway 130 (or outside the perimeter of the passageway 130) so that each passageway 130 exposes a complete area of aerosol-generating material 110 without any gaps or 'bald areas' that are missing the aerosol-generating material. The 'projected area' of the passageways 130 means the surface area bound by a contour projected onto the aerosol-generating material 110 by the perimeter of the particular passageway 130. In this way, the article 100 may be manufactured with minimal usage of aerosol-generating material and reduce the cost of the overall article 100. Alternatively, the aerosol-generating material 110 may be provided as a layer that completely covers the area beneath the barrier layer 120 so as to provide a simpler manufacturing process.

Where the aerosol-generating material 110 is provided as a plurality of spots or regions located beneath the barrier layer 120, the heater 40 may be arranged so that each spot or region can be heated independently of the other spots or regions. Thus, the spots or regions could be heated in a particular sequence. In this way, for example, the device 10 may be configured to deliver an aerosol having a range of different characteristics. For example, as the user inhales, the aerosol may vary in flavour over the time period of inhalation cycle.

Figure 5:
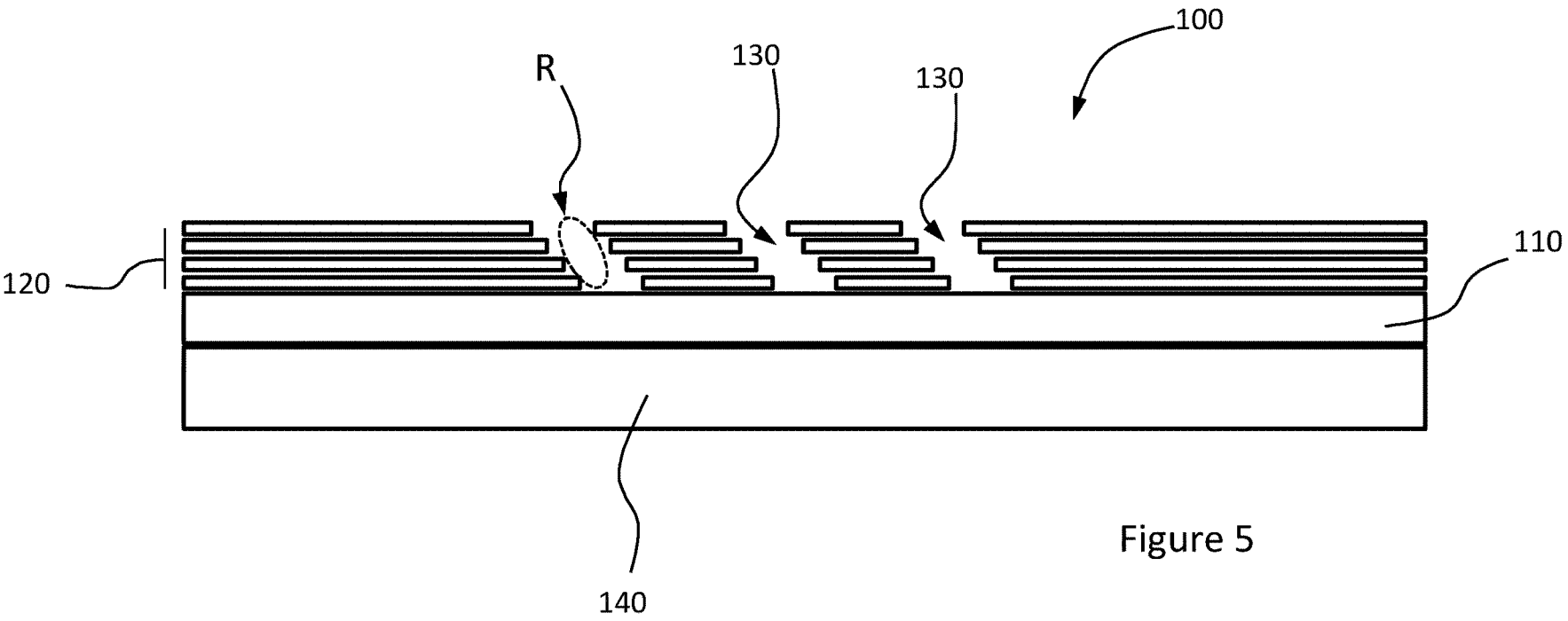
FIG. 5 shows a schematic view of another embodiment of an article.

In FIG. 5, which shows a schematic view of another embodiment of an article 100, it can be seen that the passageways 130 may extend away from the bottom side of the barrier layer 120 at an acute angle relative to the bottom side of the barrier layer 120. In other words, the passageways 130 do not have to be formed in a substantially perpendicular direction with respect to the bottom side of the barrier layer 120. In one example, when the article is placed in the receiving portion 50, the passageways 130 could be angled towards the mouthpiece of the device 20 to guide the aerosol to the mouthpiece 20 when the user inhales. Alternatively, the passageways 130 could be angled towards the inlet 30 of the device 20 to encourage mixing of the generated aerosol with the air drawn into the receiving portion 50.

FIG. 5 also illustrates how the barrier layer 120 may be constructed from a laminate of multiple layers of material as described above. The layers could be the same material or differing materials.

Figure 6:
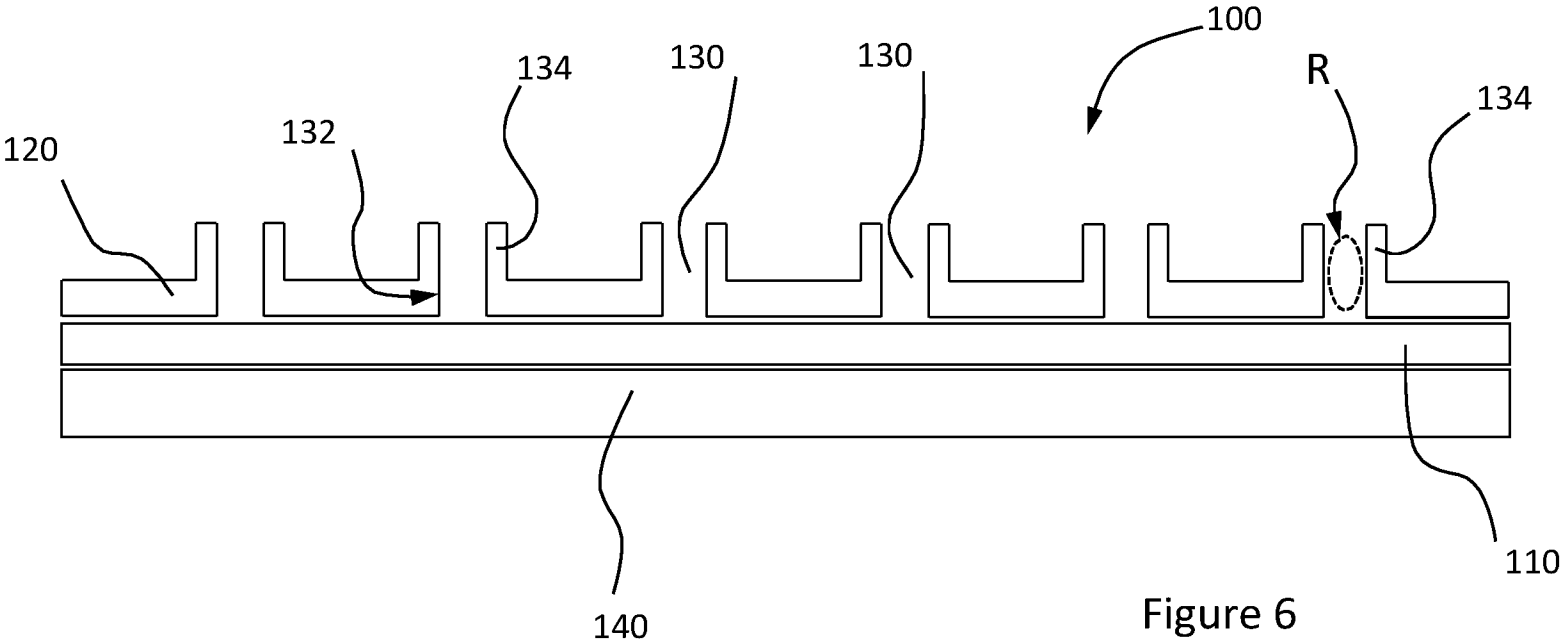
FIG. 6 shows a schematic view of another embodiment of an article.

FIG. 6 illustrates another embodiment of an article 100 in which the at least one passageway 130 is defined by the wall 132 and the wall 132 comprises a portion 134 of the wall extends a distance beyond the top side of the barrier layer 120. The portion 134 of the wall 132 may extend a certain distance from the top side of the barrier layer 120. In other words, the portion 134 of the wall 132 may extend a certain height from the top side of the barrier layer 120. For example, the portion 134 of the wall 132 may extend 0.1 mm to 5 mm from the top side of the barrier layer 120; however, in other implementations, the portion 134 may extend by a greater or small amount than specified. Extending the passageway 130 in this manner increases the volume of the condensation region R for the escaping aerosol and may further increase the effectiveness of the article 100 and device 10 to generate an aerosol in use.

The portion 134 of the wall 132 extending from the top side of the barrier layer 120 may extend around the entire perimeter of the passageway 130 defined by the barrier layer 120. In other words, the portion 134 of the wall 132 extending from the top side of the barrier layer 120 may form a chimney that extends from the top side of the barrier layer 120. For example, where the portion 134 of wall 132 extends around the perimeter of a circular shaped passageway 130, the portion 134 may take the form of an open topped cylinder.

Alternatively, the portion 134 of the wall 132 extending from the top side of the barrier layer 120 may only extend around a portion of the perimeter of the passageway 130 defined by the barrier layer 130. In other words, the portion 134 of the wall 132 extending from the top side of the barrier layer 120 may form an upstanding shield that extends from the top side of the barrier layer 120. The shield may act to divert the flow of air entering the receiving portion 50 and delay the mixing of the aerosol with the incoming air.

The article 100 may be flat or planer. The article 100 may be a flat or planer laminate. In other words, the article 100 may take the form of a thin tablet or sheet that the user may insert into the receiving portion 50 of the device 10. Providing the article 100 in a flat form may be convenient since a user may be able to purchase a conveniently sized package containing multiple sheets of the article 100 for use in the device.

Accordingly, the aerosol-generating material 110 and substrate 140 may be flat or planer. Accordingly, the heater 40 may be flat or planar to complement the shape of the article 100 and provide the maximum efficiency of heat transfer to the aerosol-generating material 110 in use.

Alternatively, in another embodiment the article 100 may be curved. The article 100 may take the form of a curved thin laminate. The curvature of the article 100 may be beneficial for matching the desired internal geometry of the receiving portion 50. Accordingly, the heater 40 may be curved to complement the shape of the article 100.

In another embodiment, the article 100 may be in the form of a tube. The aerosol-generating material 110 may be provided on the inside surface of the tube. Thus, the substrate 120, where used, may form the outside surface of the tube. The heater 40 may form a tubular receiving portion 50 and, in use, provides heat to the substrate from the outside of the tube. In one embodiment, the tubular article 100 may be inserted into the tubular receiving portion 50 for heating in use.

In another embodiment, the article 100 may be in the form of a tube, and the aerosol-generating material 110 may be provided on the outside surface of the tube. Thus, the substrate 120, where used, may form the inside surface of the tube. Such an article 100 may be used with a device 10 in which the heater 40 is in the form of a blade or rod. The heater element may be inserted into the hollow tube of the tubular article 100. Thus, heat is supplied to the article 100 from the inside of the tube.

Figure 7:
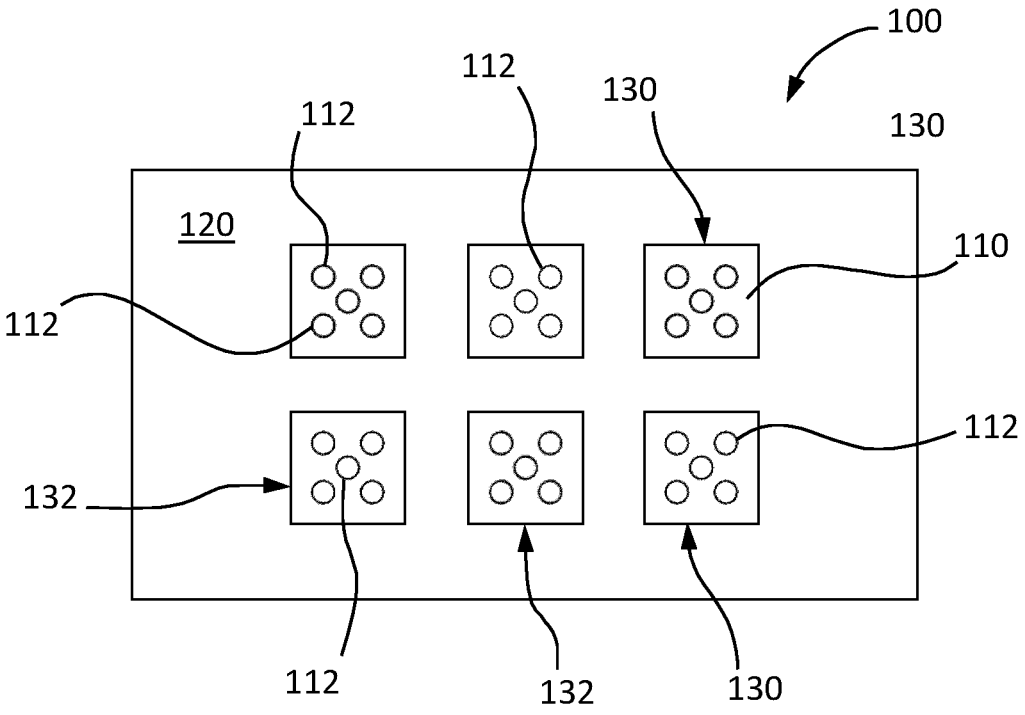
FIG. 7 shows a top view of another embodiment of an article.

Turning now to FIG. 7, which shows another embodiment of the article 100 in which a plurality of vents 112 may be provided in the aerosol-generating material 110. The plurality of vents 112 may be located in an area of the aerosol-generating material 110 exposed by the at least one passageway 130 in the barrier layer 120. Where a plurality of passageways 130 are defined by the barrier layer 120, the aerosol-generating material 110 may be provided with a plurality of vents 112 located in each area of the aerosol-generating material 110 exposed by the corresponding passageway 130.

In the example illustrated in FIG. 7, the aerosol-generating material 110 is provided with five vents 112 in each respective area exposed by the plurality of passageways 130 in the barrier layer 120. As can be seen from FIG. 7, the five vents may be arranged in a quincunx arrangement. This is the traditional arrangement of five dots seen on a six-sided die.

Any suitable numbers of vents 112 may be provided in each area corresponding to the respective at least one passageway 130. For example, a single vent 112 may be provided or 10 vents 112 may be provided.

The Applicant has found that providing at least one vent 112 in the aerosol-generating material 110 enhances the amount of aerosol generated from the aerosol-generating material. Furthermore, the Applicant has also found that, when the vent(s) 112 are provided in the aerosol-generating material 110, the effect produced by providing at least one passageway 130 above the aerosol-generating material layer 130 is further enhanced because of the vents 112. Further still, the Applicant has also found that the provision of the vent(s) 112 and the at least one passageway 130 reduces the amount of aerosol deposited on the lid 60 of the device 10 in use. This has the benefit of increasing the efficiency of the device since a greater proportion of aerosol, generated by the device 10, is ultimately delivered to the user. Additionally, the amount of lid cleaning required by the user is reduced. The Applicant has found that the provision of five vents 112 in each respective area exposed by the plurality of passageways 130 in the barrier layer 120 is particularly beneficial in enhancing aerosol production and reducing the amount of aerosol deposited on the lid 60 of the device.

Figure 8:
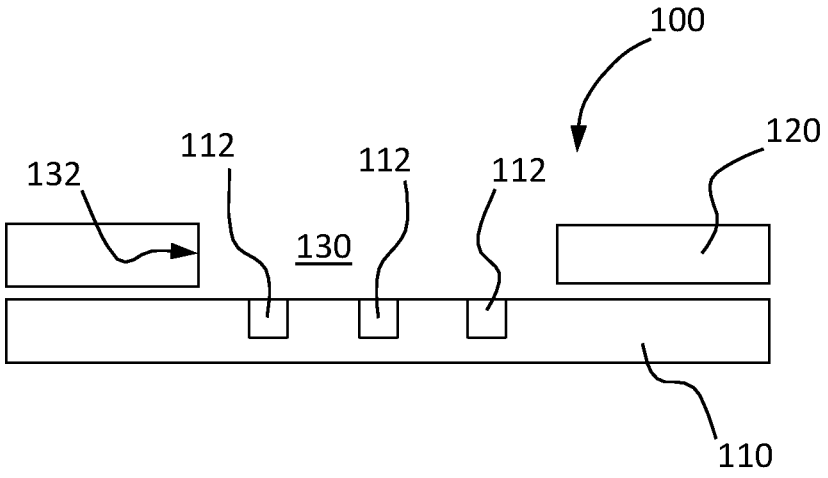
FIG. 8 shows a schematic view of another embodiment of an article.

FIG. 8 illustrates one embodiment of the article 100 in which the plurality of vents 112 may comprise apertures. In the example of FIG. 8, the apertures may comprise blind holes in the aerosol-generating material 110. Alternatively, the apertures may comprise holes that pass completely through the layer 110. Where the aerosol-generating material comprises a gel, the apertures may be formed by protrusions provided in the mold in an example where the gel is molded. Alternatively, the apertures may be cut into the aerosol-generating material, for example, by use of a laser.

Figure 9:
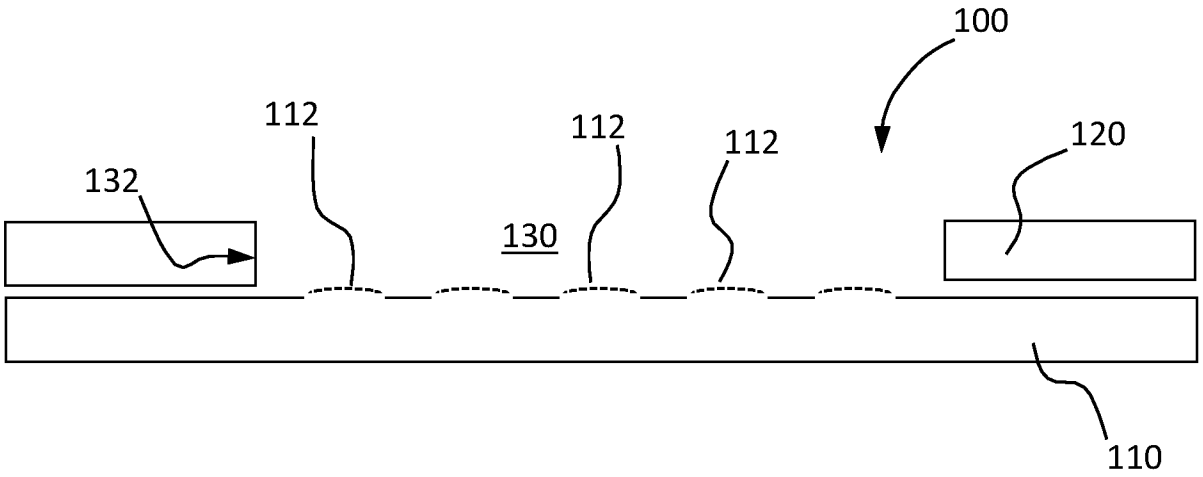
FIG. 9 shows a schematic view of another embodiment of an article.

In another embodiment, which is shown in FIG. 9, the plurality of vents 112 provided in the article 100 may comprise burst points. The burst points allow any aerosol building up inside the aerosol-generating material 110 to escape by way of 'bursting'. The burst points may be formed by weakening a portion of the aerosol-generating material layer at a point corresponding to the position where a vent 112 is desired. The weakening process may be performed by, for example, an etching process. In another example, the weakening process may be performed by laser cutting.

Where the aerosol-generating material 110 is heated by the heating element 40, the best heating performance may be where the aerosol-generating material 110 is heated by conduction. Hence, contact of the aerosol-generating material 110 with the heating element 40 is desirable.

The receiving portion 50 of the non-combustible aerosol provision device 10 may be configured to, in use, press the article 100 receivable in the receiving portion 50 against the heater 40. In one embodiment, a clip may be provided to press the article 100 against the heater 40. In other implementations, the heater 40 may be moved to contact the article 100. In both cases, this can improve the conductive transfer of heat to the aerosol-generating material 110. In another embodiment, the lid 60 of the non-combustible aerosol provision device 10 may be configured to, in use, press the article 100 receivable in the receiving portion 50 against the heater 40. This will maximize the conductive transfer of heat to the aerosol-generating material 110.

In one embodiment, the lid 60 may be provided with protrusions 62 that are arranged so that, when the lid 60 is in the closed position, the protrusions 62 contact the article 100 receivable in the device 10. The protrusions 62 may be rigid. Thus, when the lid 60 is in the closed position, the protrusions 62 press down on the article 100 and push it against the heater 4

Figure 10:
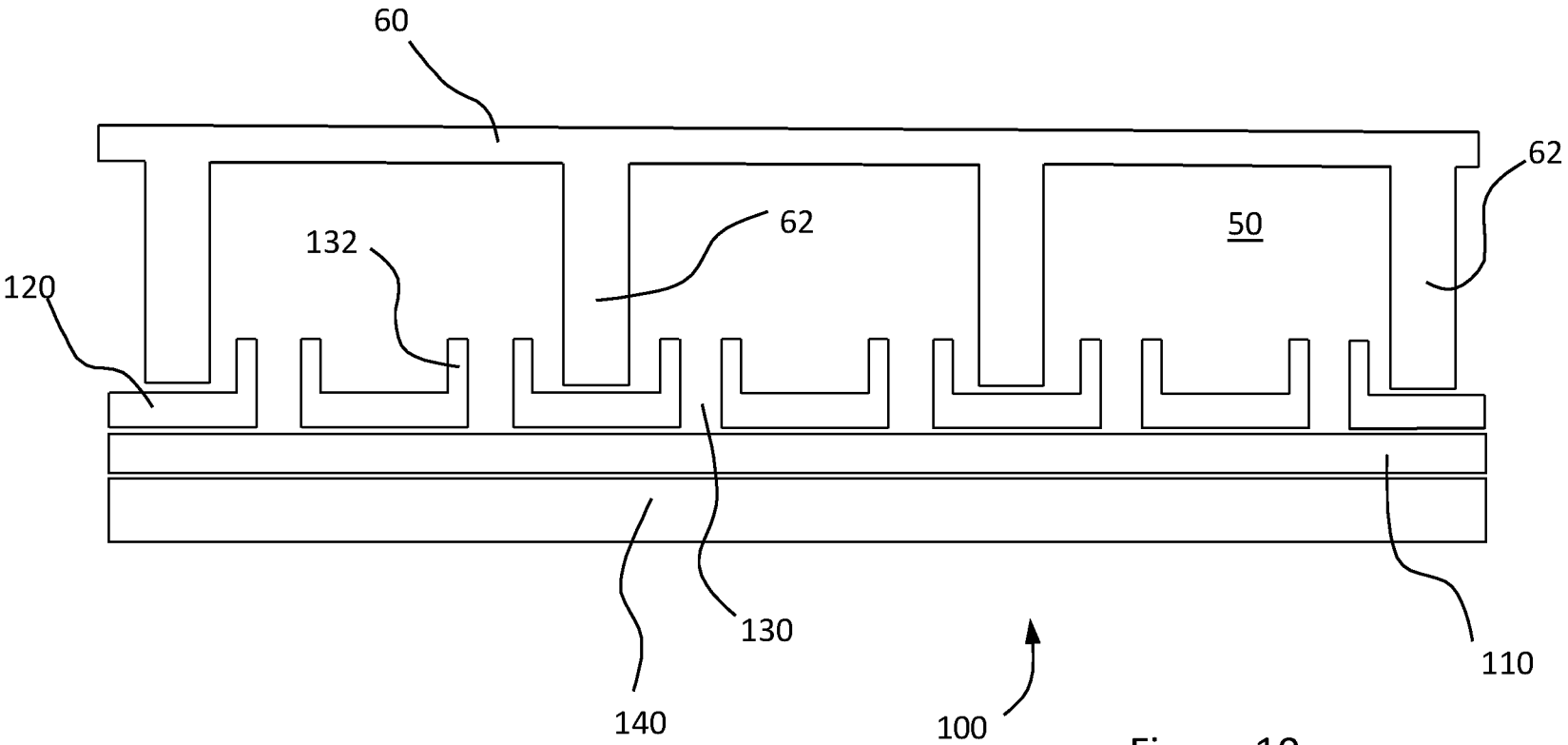
FIG. 10 shows a schematic view of an embodiment of an article according to the invention received within a receiving portion of a non-combustible aerosol provision device.

As FIG. 10 shows, the protrusions 62 may contact the article 100 at appropriate locations, for example, between the passageways 130. The protrusions may contact the barrier layer 120 of the article 100.

The protrusions 62 may be longer than the length portion 134 of the wall 132 that extends a distance beyond the top side of the barrier layer 120. As FIG. 9 shows, this ensures that air and aerosol are allowed to pass over the top of the portion 134 of the wall 132, thereby ensuring extraction of the aerosol generated from the article.

A biasing force may be provided by the lid 60 so that the protrusions 62 provide a constant force on the article 100 when it is received within the receiving portion 50 and the lid is closed. For example, the lid may have a resilient catch that both provides a force to keep the lid closed and maintain a force on the lid 60, which is then transmitted to the article 100 via the protrusions. Thus, the article 100 will be pressed against the heater 40 throughout its use in the non-combustible aerosol provision device 100.

Alternatively, a biasing force may be provided by the protrusions 62 to provide a constant force on the article 100 when it is received within the receiving portion 50 and the lid is closed. For example, the protrusions 62 may be resilient rather than rigid so as to transmit a force to the article 100 via the protrusions when the lid 60 is closed. In another example, the protrusions may be spring-loaded such that they transmit a force to the article 100 via the protrusions when the lid 60 is closed.

Providing features on the lid 60 that press the article 100 against the heater 40 in this manner ensure there is good heat conductive contact between the article 100 and the heater 40. Thus, the device 10 is able to effectively generate an aerosol from the article 100.

Figure 11:
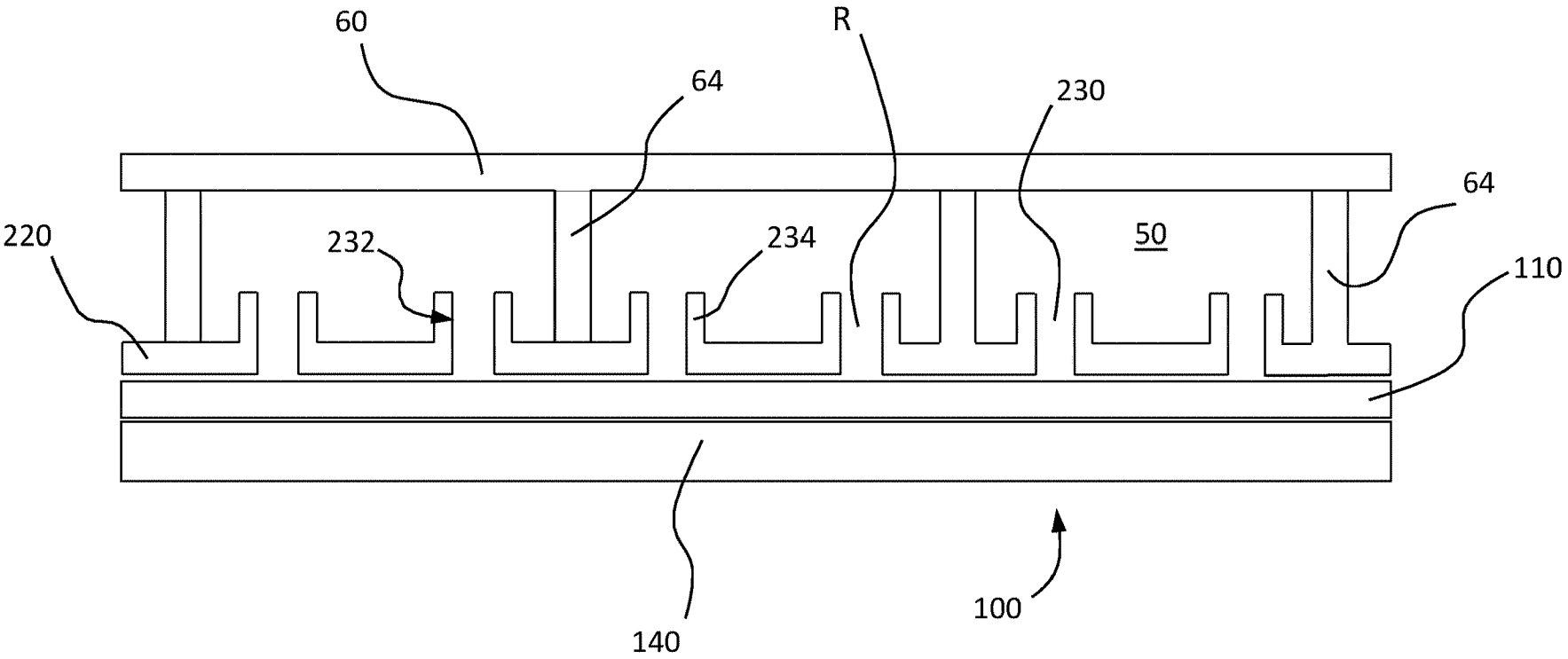
FIG. 11 shows a schematic view of another embodiment of an article according to the invention received within a receiving portion of a non-combustible aerosol provision device.

In another embodiment of non-combustible aerosol provision device 10, as shown in FIG. 11, the device 10 may comprise a barrier. In this embodiment, the barrier layer of the non-combustible aerosol provision device 10 is to provide at least one condensation region for the aerosol escaping from the aerosol-generating material. In an example, the device 10 may comprise a barrier layer 220 as illustrated in FIG. 11. The barrier layer 220 may have a bottom side that is configured to be positioned adjacent to the top side of the aerosol-generating material layer 100 of the article 100 when it is received in the receiving portion 50. In other words, in this embodiment, the barrier layer 220 is provided on the non-combustible aerosol provision device 10 itself rather that the article 100.

At least one passageway 230 is defined by the barrier layer 220. The at least one passageway 230 extends from the bottom side of the barrier layer 220 and extends away from the top side of the aerosol-generating material 110 when it is received in the receiving portion 50. As discussed above, the at least one passageway is configured to allow aerosol to escape from the aerosol-generating material 110 and provide a condensation region R for the escaping aerosol when the article 100 is placed in the receiving portion 50 of the device 10 and a user activates the device, for example, by inhaling on the mouthpiece 20.

As with the embodiments described above, the at least one passageway 230, described above, may be one of a plurality of passageways 230 defined by the barrier layer 220. Each one of the plurality of passageways 230 may be identical. Each passageway 230 provides a corresponding condensation region for the escaping aerosol to condense before the aerosol is drawn from of the receiving portion 50 and out of the mouthpiece as the user inhales on the device 10.

The at least one passageway 230 may be defined by a wall 232 of the barrier layer 220. As with the barrier layer 120 described above a portion 234 of the wall 232 may extend a distance beyond the top side of the barrier layer 220. For example, the portion 234 of the wall 232 may extend 0.1 mm to 10 mm from the top side of the barrier layer 220. The portion 234 of the wall 232 extending from the top side of the barrier layer 220 may extend around the entire perimeter of the passageway 230 defined by the barrier layer 220. Thus, similarly to the example described above, the portion 134 of the wall 132 extending from the top side of the barrier layer 220 may form a chimney that extends from the top side of the barrier layer 220. For example, the portion 234 may take the form of an open topped cylinder.

Alternatively, the portion 234 of the wall 232 extending from the top side of the barrier layer 220 may only extend around a portion of the perimeter of the passageway 230 defined by the barrier layer 230. Thus, similarly to the example described above, the portion 234 of the wall 232 extending from the top side of the barrier layer 220 may form an upstanding shield that extends from the top side of the barrier layer 220. The shield may act to divert the flow of air entering the receiving portion 50 and delay the mixing of the aerosol with the incoming air.

As with the embodiment of device 10 described above, the article 100 may be configured to be placed adjacent to a heater 40 in the receiving portion 50 of the device 10 so that aerosol-generating material layer 100 may be heated. The article 100 may also comprise a substrate 140 as described above. The substrate 140 may be placed adjacent to the heater 40.

The non-combustible aerosol provision device 10 may comprise the closable lid 60, which is shown in FIG. 1 and is arranged so that it covers the article 100, when it is received in the device 10, and allows a space for the aerosol generated from the article 100 to escape. In one embodiment, the closable lid 60 may comprise the barrier layer 220. One example of the non-combustible aerosol provision device 10 where the closable lid 60 comprises the barrier layer 220 is illustrated in FIG. 11.

FIG. 11 shows that the barrier layer 220 may be attached to the lid 60 by ribs 64 that extend from the underside of the closable lid 60 to the top side of the barrier layer 220. As can be seen from FIG. 11, the attachment between the lid 60 and barrier layer 220 is arranged so that a space is provided that allows for the aerosol, generated from the article 100, to escape. In the example of FIG. 11, the ribs 64 extend from the top side of the barrier layer 220 in locations between the passageways 130. Thus, there is no interference with the fluid path of the escaping aerosol when it is generated. Other attachment arrangements may also ensure that there is no interference with the fluid path of the escaping aerosol.

Since the barrier layer 220 is attached to the lid 60 in the example above, it can also be used to ensure that there is good heat conductive contact between the article 100 and the heater 40. The barrier layer 220 may be arranged so that, when the lid 60 is in the closed position, the barrier layer 220 is configured to contact the article 220 when it is received in the device.

A biasing force may be provided by the lid 60 so that the barrier layer 220 provides a constant force on the article 100 when it is received within the receiving portion 50 and the lid 60 is closed. For example, the lid 60 may have a resilient catch that both provides a force to keep the lid closed and maintain a force on the lid 60, which is then transmitted to the article 100 via the barrier layer 220. Thus, the article 10 will be pressed against the heater 40 throughout its use in the non-combustible aerosol provision device 10.

The article 100 that is to be received within the receiving portion 50 of the non-combustible aerosol provision device 10 may include a plurality of vents 112 provided in the aerosol-generating material 110. The plurality of vents 112 may be located in an area of the aerosol-generating material 110 exposed by the at least one passageway 230 in the barrier layer 220. Where a plurality of passageways 230 are defined by the barrier layer 220, the aerosol-generating material 110 may be provided with a plurality of vents 112 located in each area of the aerosol-generating material 110 exposed by the corresponding passageway 230.

The article 100 may be supplied to a user in a single pack. The article 100 may be supplied to a user as one of a package of multiple like articles 100. The article 100 may be supplied to a user as one of a package of multiple like articles 100, each articles 100 having a different flavor.

The article 100 may be supplied to a user as part of a 'starter pack', which contains an non-combustible aerosol provision device 10 as described herein and one, or several, articles 100. The device 10 may be a hand-held device.

In another embodiment, the mouthpiece 20 may be supplied as a component of the article 100. Accordingly, the mouthpiece 20 is a part of a disposable article 100. In this embodiment, when the article 100 is received in the receiving portion 50, the mouthpiece 20 is also assembled to the non-combustible aerosol provision device 10 so that the user can inhale an aerosol generated from the article 10. In this way, the hygiene of the device 10 may be improved and there may be a reduction in deposition of condensed matter on the inner surface of the device 10.

Figure 12:
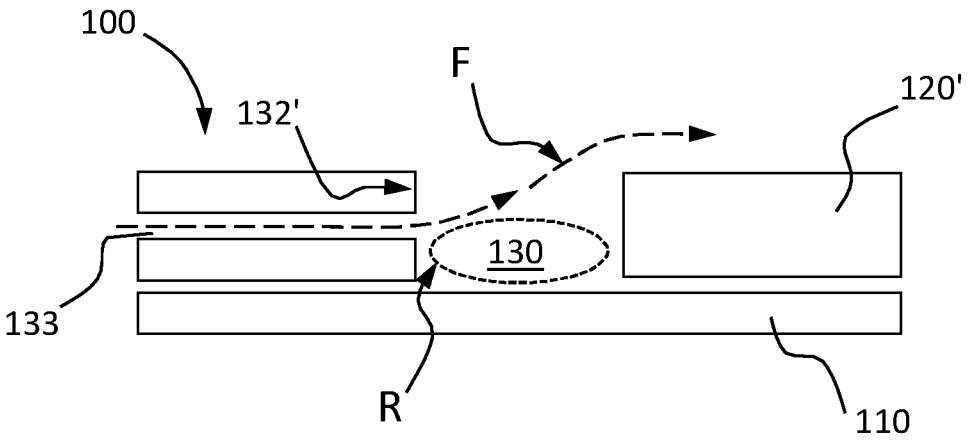
FIG. 12 shows a schematic view of another embodiment of an article.

While the above embodiments have generally described a system in which air passes over the top side of the article 100, it should be appreciated that the barrier may be provided with one or more passages that permit at least a portion of the air drawn into the non-combustible aerosol provision device 10 to flow into the barrier. The one or more passages may permit air to flow into one or more of the passageways. For example, a barrier layer 120' may be provided with one or more air inlets 133. In one example, and with reference to FIG. 12, the barrier layer 120' may be provided with an air inlet 133 which effectively passes through to the wall 132' of the passageway 130. In this example, the air inlet 133 meets the wall 132' at a distance approximately halfway between the bottom and top of the wall 132', but it should be understood that the air inlet 133 could alternatively be provided higher up or lower down the wall 132 depending on the specific application at hand. In this example, when a user inhales air through the device 10, air passes along air inlet 133 to the passageway 130 where it collects and condenses the generated vapor. The dotted arrow F in FIG. 12 schematically shows the path the air travels; however, it should be appreciated that the actual path may be somewhat different from that shown. In essence, the provision of an air inlet 133 partway down the height of the wall 132 is thought to enable air to pass into and along part of the passageway 130 to collect a larger proportion of the generated vapor. When a plurality of passageways 130 are provided, each passageway may have its own air inlet 133 or share one or more air inlets 133 (that is, a common air inlet 133 may branch off into a plurality of branches that each provide an inlet to individual passageways 130). The air inlet 133 may be formed in any suitable way—for example, with reference to FIG. 5, one of the layers of the laminate may be provided with a cut-out section such that, when the layer is sandwiched between two other layers, the air inlet 133 is formed.

Figure 13:
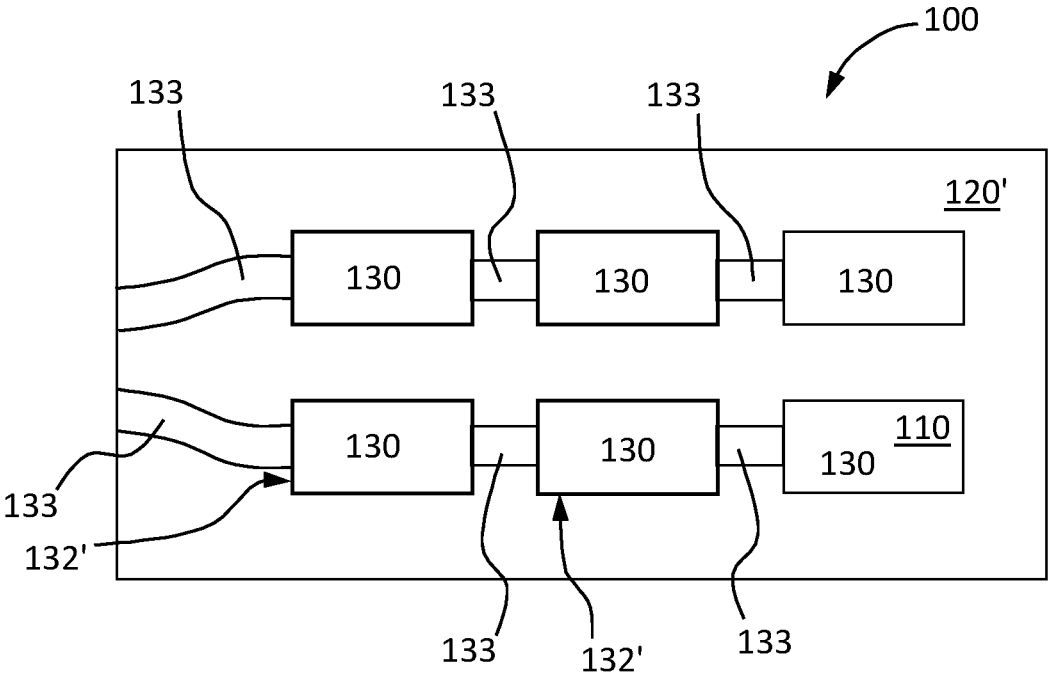
FIG. 13 is a top view of another embodiment of an article.

While the above embodiments have generally described one or more discrete passageways 130, 230, it should be appreciated that the passageways may in some implementations be linked. For example, with reference to FIG. 13, a plurality of passageways 130 is linked via air inlet 133. In this arrangement, each of the walls 132 forming the passageways 130 are additionally provided with an air outlet which correspondingly links to an adjacent passageway 130 (i.e., an outlet for one passageway is an air inlet 133 for another passageway). Accordingly, air drawn in along one air inlet 133 can pass through multiple passageways 130. It should be noted that in such an arrangement, air is not prevented from exiting individual passageways 130 as shown in FIG. 12 for instance. Instead, a portion of the air may exit the passageway 130 as in FIG. 12, while another portion of the air may pass through to the subsequent passageway 130.

As used herein, the terms "flavor" refers to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

"Aerosol-generating material" is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

In some embodiments, the amorphous solid may comprise a colorant. The addition of a colorant may alter the visual appearance of the amorphous solid. The presence of colorant in the amorphous solid may enhance the visual appearance of the amorphous solid and the aerosol-generating material. By adding a colorant to the amorphous solid, the amorphous solid may be color-matched to other components of the aerosol-generating material or to other components of an article comprising the amorphous solid.

A variety of colorants may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material comprising the amorphous solid. In some embodiments, the addition of a colorant to the amorphous solid renders it visually indistinguishable from other components in the aerosol-generating material.

The colorant may be incorporated during the formation of the amorphous solid (e.g. when forming a slurry comprising the materials that form the amorphous solid) or it may be applied to the amorphous solid after its formation (e.g. by spraying it onto the amorphous solid).

In certain embodiments, the aerosol-generating material or the amorphous solid comprises a gelling agent. The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

The aerosol-generating material or the amorphous solid may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

In certain embodiments, the aerosol-generating material or the amorphous solid comprises a gelling agent comprising a cellulosic gelling agent and/or a non-cellulosic gelling agent, an active substance and an acid.

The aerosol-generating material or the amorphous solid may comprise one or more active substances and/or flavors, one or more aerosol-former materials, and optionally one or more other functional material.

In some embodiments, the aerosol-former material comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

In some embodiments, the aerosol-generating material or the amorphous solid comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The aerosol-generating material or the amorphous solid may comprise one or more cannabinoid compounds selected from the group consisting of cannabidiol (CBD) and THC (tetrahydrocannabinol).

The aerosol-generating material or the amorphous solid may comprise cannabidiol (CBD).

The aerosol-generating material or the amorphous solid may comprise nicotine and cannabidiol (CBD).

The aerosol-generating material or the amorphous solid may comprise nicotine, cannabidiol (CBD), and THC (tetrahydrocannabinol).

As used herein, the term 'aerosol-generating material' may include an 'aerosol generating agent', which refers to an agent that promotes the generation of an aerosol. An aerosol generating agent may promote the generation of an aerosol by promoting an initial vaporization and/or the condensation of a gas to an inhalable solid and/or liquid aerosol.

Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol generating agent may suitably have a composition that does not dissolve menthol. The aerosol generating agent may suitably comprise, consist essentially of or consist of glycerol.

As used herein, the term 'tobacco material' refers to any material comprising tobacco or derivatives therefore. The term 'tobacco material' may include one or more of tobacco, tobacco derivatives, expanded tobacco, reconstituted tobacco or tobacco substitutes. The tobacco material may comprise one or more of ground tobacco, tobacco fibre, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An article for use within a non-combustible aerosol provision system, the article comprising:

an aerosol-generating material having a top side, wherein the aerosol-generating material comprises an amorphous solid;

a barrier positioned adjacent to the top side of the aerosol-generating material;

at least one passageway defined by the barrier and extending away from the top side of the aerosol-generating material;

wherein the barrier has a top side and a bottom side and wherein the at least one passageway extends from the bottom side of the barrier to at least a top side of the barrier; and wherein the at least one passageway is configured to, in use, allow aerosol to escape from the aerosol-generating material and provide a condensation region for the escaping aerosol.

2. An article according to claim 1, wherein the barrier is paper or card.

3. An article according to claim 1, wherein the bottom side of the barrier is bonded to the top side of the aerosol-generating material.

4. An article according to any claim 1, wherein a plurality of vents are provided in the aerosol-generating material and wherein the plurality of vents is located in an area of the aerosol-generating material exposed by the at least one passageway.

5. An article according to claim 1, wherein the barrier comprises at least one inlet to permit air to flow, in use, into the at least one passageway.

6. An article according to claim 1, wherein the article comprises a substrate and a bottom side of the aerosol-generating material is positioned adjacent to a top side of the substrate.

7. The article according to claim 1, wherein the article has a bottom side that is configured to be placed adjacent to a heater provided in a non-combustible aerosol provision device.

8. An article according to claim 1, wherein the article comprises a susceptor.

9. A non-combustible aerosol provision device comprising an induction heating system and a receiving portion, and wherein the receiving portion is configured to receive an article according to claim 8.

10. A non-combustible aerosol provision device comprising a receiving portion, the receiving portion including a heater and a closable lid, and wherein the receiving portion is configured to receive, adjacent to the heater, an article according to claim 1.

11. The device according to claim 10, wherein the heater is a flat metallic bed and wherein the heater is heated by one of: conduction, convection, induction, or radiation.

12. The device according to claim 11, wherein the lid is configured to, in use, press the article receivable in the device against the heater.

13. The device according to claim 9, wherein the device comprises a mouthpiece and an air inlet.

14. A non-combustible aerosol provision device, the device comprising:

a receiving portion, the receiving portion including a heater, wherein the receiving portion is configured to receive an article adjacent to the heater, the article comprising an aerosol-generating material having a top side;

a barrier having a bottom side, the bottom side of the barrier configured to be positioned adjacent to the top side of the aerosol-generating material when it is received in the receiving portion; and at least one passageway defined by the barrier, the at least one passageway extending from the bottom side of the barrier and extending away from the top side of the aerosol-generating material when it is received in the receiving portion, wherein the at least one passageway is configured to, in use, allow aerosol to escape from the aerosol-generating material and provide a condensation region for the escaping aerosol.

15. The according to claim 14, wherein the device further comprises a closable lid, which is arranged so that it covers the article when it is received in the device and allows a space for the aerosol generated from the article to escape, wherein the closable lid comprises the barrier.

16. The device according to claim 15, wherein the barrier is arranged so that, when the lid is in the closed position, the barrier is configured to contact the article when received in the device.

17. The device according to claim 16 wherein the closable lid is biased such that, when the lid is in the closed position, the barrier provides a constant load force on the article when received in the device.

18. The device according to claim 14 wherein the device further comprises a mouthpiece and an air inlet.

19. A non-combustible aerosol provision system comprising: the non-combustible aerosol provision device according to claim 14; and an article comprising an aerosol-generating material.

* * * * *